US011932473B2

(12) United States Patent
Cho et al.

(10) Patent No.: US 11,932,473 B2
(45) Date of Patent: Mar. 19, 2024

(54) TRAY

(71) Applicant: Samsung Display Co., Ltd., Yongin-si (KR)

(72) Inventors: Jin-Wook Cho, Cheonan-si (KR); Min-Yeob Kang, Cheonan-si (KR); Nampyo Hong, Cheonan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/974,954

(22) Filed: Oct. 27, 2022

(65) Prior Publication Data

US 2023/0242320 A1 Aug. 3, 2023

(30) Foreign Application Priority Data

Feb. 3, 2022 (KR) ..... 10-2022-0013919

(51) Int. Cl.
*B65D 85/30* (2006.01)
*B65D 65/40* (2006.01)
*B65D 81/05* (2006.01)

(52) U.S. Cl.
CPC ..... *B65D 81/05* (2013.01); *B65D 65/40* (2013.01); *B65D 85/30* (2013.01)

(58) Field of Classification Search
CPC ..... B65D 81/05; B65D 65/40; B65D 85/30
USPC ..... 206/557, 448, 454, 518, 519
See application file for complete search history.

(56) References Cited

U.S. PATENT DOCUMENTS 5,375,719 A * 12/1994 Mittmann ..... B65D 21/0233 206/520
2005/0252814 A1* 11/2005 Lobman ..... A47J 27/17 206/518
2008/0099358 A1* 5/2008 Bell ..... B65D 25/107 206/319
2013/0098800 A1* 4/2013 Rehmanji ..... B65D 1/34 206/557
2019/0335746 A1* 11/2019 Freedman ..... B65D 25/14
2020/0181849 A1* 6/2020 Esgueva Gutierrez ..... D21H 17/17
2022/0097946 A1 3/2022 Kim et al.
2023/0040636 A1* 2/2023 Kuiper ..... B32B 27/08
2023/0227199 A1* 7/2023 Clarke ..... B65D 1/40 206/557

FOREIGN PATENT DOCUMENTS

JP 3223389 B2 10/2001
JP 2007216978 A 8/2007
JP 6484578 B2 3/2019
JP 3223389 U 10/2019
KR 102085500 B1 3/2020
KR 1020200145892 A 12/2020

(Continued)

*Primary Examiner* — Jacob K Ackun
(74) *Attorney, Agent, or Firm* — CANTOR COLBURN LLP

(57) ABSTRACT

A tray includes a bottom portion including a plurality of protrusion patterns and a sidewall portion protruded from the bottom portion. The sidewall portion includes a first side portion provided with a groove defined therein and extending from the bottom portion, an upper surface extending from the first side portion to a direction away from the bottom portion in a plan view, and a second side portion extending from the upper surface and facing the first side portion.

15 Claims, 9 Drawing Sheets

(56) References Cited

FOREIGN PATENT DOCUMENTS

| | | | |
|---|---|---|---|
| KR | 1020210027618 | A | 3/2021 |
| KR | 1020220044022 | A | 4/2022 |

* cited by examiner

TRAY

This application claims priority to Korean Patent Application No. 10-2022-0013919, filed on Feb. 3, 2022, and all the benefits accruing therefrom under 35 U.S.C. § 119, the content of which in its entirety is herein incorporated by reference.

BACKGROUND

1. Field

The disclosure relates to a tray. More particularly, the disclosure relates to a tray with improved product efficiency and capable of improving a stability of a transfer target.

2. Description of the Related Art

A tray to transfer a display panel is used when stacking and storing at least one display panel or transferring the display panel in an intermediate process. Multiple display panels are stacked in the tray, and then, stored and transferred so as to reduce costs. Multiple trays are sequentially stacked to transfer the display panels.

SUMMARY

When the display panels move within a loading space in the tray, the display panels are damaged due to collision with surrounding components.

The disclosure provides a tray with improved product efficiency.

The disclosure provides a tray capable of improving a stability of a target to be transferred.

Embodiments of the invention provide a tray including a bottom portion including a plurality of protrusion patterns and a sidewall portion protruded from the bottom portion. The sidewall portion includes a first side portion provided with a groove defined therein and extending from the bottom portion, an upper surface extending from the first side portion to a direction away from the bottom portion in the plan view, and a second side portion extending from the upper surface and facing the first side portion.

In an embodiment, the groove is spaced apart from the bottom portion.

In an embodiment, the first side portion includes a first side surface extending from the bottom portion, a groove bottom surface extending from the first side surface and defining the groove, a second side surface extending from the groove bottom surface and defining the groove, a groove upper surface extending from the second side surface and defining the groove, and a third side surface extending from the groove upper surface and connected to the upper surface.

In an embodiment, an extension line of the fourth side surface and an extension line of the fifth side surface are spaced apart from each other with a distance equal to or greater than about 1.0 millimeter (mm) and equal to or smaller than about 1.5 mm.

In an embodiment, the groove upper surface is inclined with respect to the groove bottom surface.

In an embodiment, the first side portion is further provided with an additional groove recessed from the groove bottom surface.

In an embodiment, the additional groove has a width smaller than a width of the groove.

In an embodiment, the width of the additional groove is equal to or smaller than about 5 mm.

In an embodiment, the additional groove has a height equal to or greater than about 3 mm.

In an embodiment, the groove has a width equal to or greater than about 10 mm.

In an embodiment, the second side portion includes a fourth side surface extending from the upper surface and a fifth side surface extending from the fourth side surface to the direction away from the bottom portion in the plan view.

In an embodiment, an extension line of the fourth side surface and an extension line of the fifth side surface are spaced apart from each other with a distance equal to or greater than about 1.0 mm and equal to or smaller than about 1.5 mm.

In an embodiment, the bottom portion further includes a movement preventing member disposed at a center of the bottom portion and having a cylindrical shape.

In an embodiment, each of the plurality of protrusion patterns has a hexagonal shape.

In an embodiment, each of the bottom portion and the sidewall portion includes a base tray, an adhesive layer, and a non-slip pad, which are sequentially stacked.

According to the above, as each of the trays includes a non-slip pad, it is able to load the display panel in the tray without employing a separate part, and the display panels are prevented from moving when being transferred. The trays are prevented from being stuck together by a margin space between the sidewall portions of the trays and the additional groove.

The tray is used not only for the display panel but also for the transportation of other products. Accordingly, a mold to manufacture an additional tray is not desired, a manufacturing cost is reduced, and a product efficiency is improved. In addition, since the tray is used in common, a purchase quantity of the tray is reduced and a work of replacing the tray is omitted. Thus, a productivity is improved.

BRIEF DESCRIPTION OF THE DRAWINGS

The above and other advantages of the disclosure will become readily apparent by reference to the following detailed description when considered in conjunction with the accompanying drawings in which.

DETAILED DESCRIPTION

Figure 1:
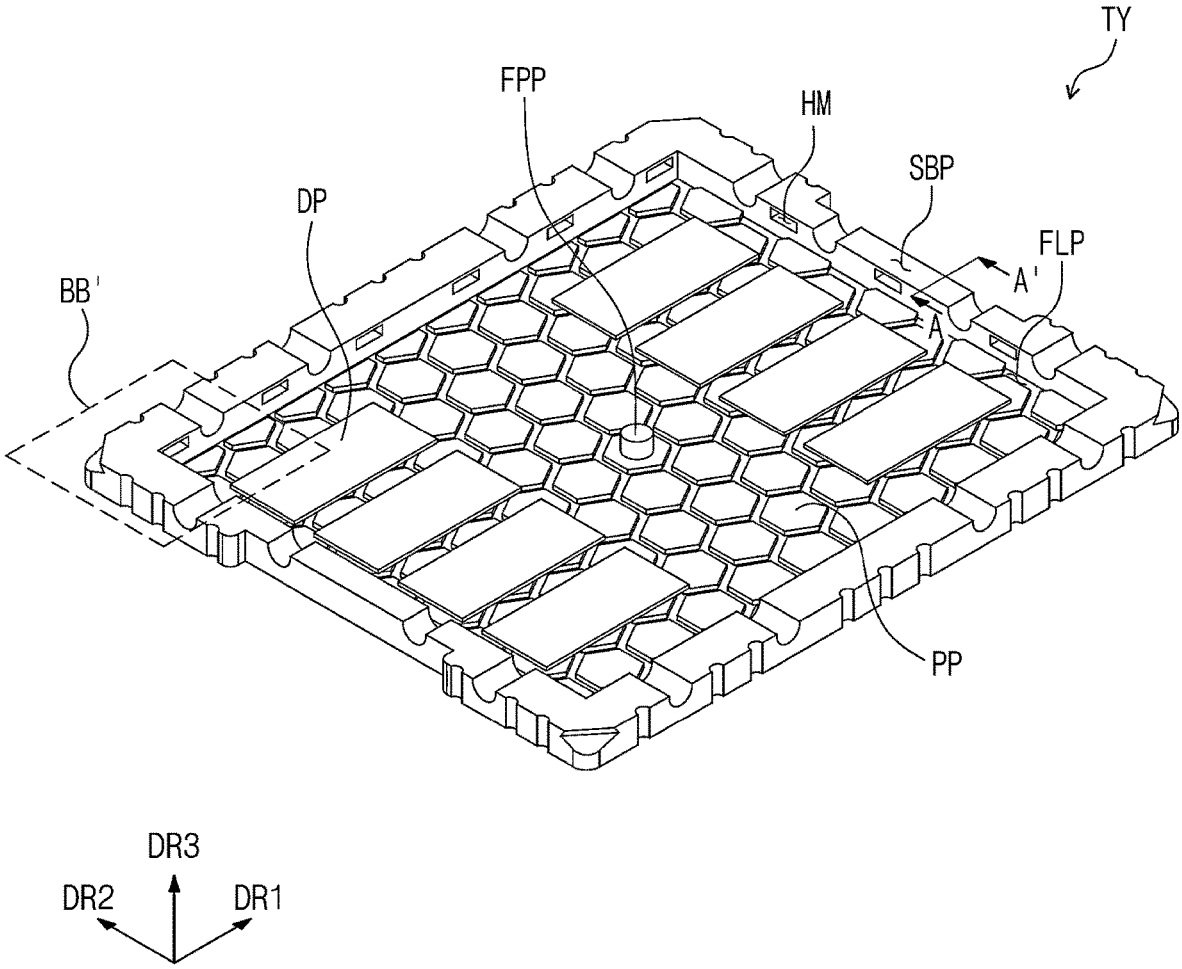
FIG. 1 is a perspective view of an embodiment of a tray according to the disclosure.

In the disclosure, it will be understood that when an element (or area, layer, or portion) is also referred to as being "on", "connected to" or "coupled to" another element or layer, it may be directly on, connected or coupled to the other element or layer or intervening elements or layers may be present.

Like numerals refer to like elements through. In the drawings, the thickness, ratio, and dimension of components are exaggerated for effective description of the technical content. As used herein, the term "and/or" may include any and all combinations of one or more of the associated listed items.

It will be understood that, although the terms first, second, etc. may be used herein to describe various elements, these elements should not be limited by these terms. These terms are only used to distinguish one element from another element. Thus, a first element discussed below could be termed a second element without departing from the teachings of the disclosure. As used herein, the singular forms, "a", "an" and "the" are intended to include the plural forms as well, unless the context clearly indicates otherwise.

Spatially relative terms, such as "beneath", "below", "lower", "above", "upper" or the like, may be used herein for ease of description to describe one element or feature's relationship to another elements or features as shown in the drawing figures.

It will be further understood that the terms "include" and/or "including", when used in this specification, specify the presence of stated features, integers, steps, operations, elements, and/or components, but do not preclude the presence or addition of one or more other features, integers, steps, operations, elements, components, and/or groups thereof.

The term "part" or "unit" as used herein is intended to mean a software component or a hardware component that performs a predetermined function. The hardware component may include a field-programmable gate array ("FPGA") or an application-specific integrated circuit ("ASIC"), for example. The software component may refer to an executable code and/or data used by the executable code in an addressable storage medium. Thus, the software components may be object-oriented software components, class components, and task components, and may include processes, functions, attributes, procedures, subroutines, segments of program code, drivers, firmware, micro codes, circuits, data, a database, data structures, tables, arrays, or variables, for example.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term "about" can mean within one or more standard deviations, or within ±30%, 20%, 10%, 5% of the stated value, for example.

Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the disclosure will be described with reference to accompanying drawings.

FIG. 1 is a perspective view of an embodiment of a tray TY according to the disclosure.

Referring to FIG. 1, the tray TY may include a bottom portion FLP and a sidewall portion SBP. A plurality of display panels DP may move while being disposed on the bottom portion FLP of the tray TY.

The bottom portion FLP may be a surface substantially parallel to a plane defined by a first direction DR1 and a second direction DR2. A third direction DR3 may be substantially parallel to a normal direction of the bottom portion FLP. The bottom portion FLP may include a plurality of protrusion patterns PP. In FIG. 1, each of the protrusion patterns PP may have a hexagonal shape, however, it should not be limited thereto or thereby. In an embodiment, each of the protrusion patterns PP may have a polygonal, circular, or irregular shape.

The bottom portion FLP may include a movement preventing member FPP. The movement preventing member FPP may prevent a plurality of trays TY from being bent when the trays TY are stacked and may prevent a slip sheet (not shown) disposed on the tray TY from moving. The movement preventing member FPP may be disposed at a center of the bottom portion FLP and may have a cylindrical shape. FIG. 1 shows the movement preventing member FPP having the cylindrical shape as an illustrative embodiment, however, the disclosure should not be limited thereto or thereby. In an embodiment, the movement preventing member FPP may have a cuboid or hexagonal column shape, and in a case where no slip sheet (not shown) is present, the movement preventing member FPP may be omitted.

The sidewall portion SBP may protrude from the bottom portion FLP. The sidewall portion SBP may be disposed to surround an edge of the bottom portion FLP and may extend from the bottom portion FLP to the third direction DR3. The sidewall portion SBP may be provided with a groove defined therein. The groove may be provided in plural and may be spaced apart from the bottom portion FLP.

Figure 2:
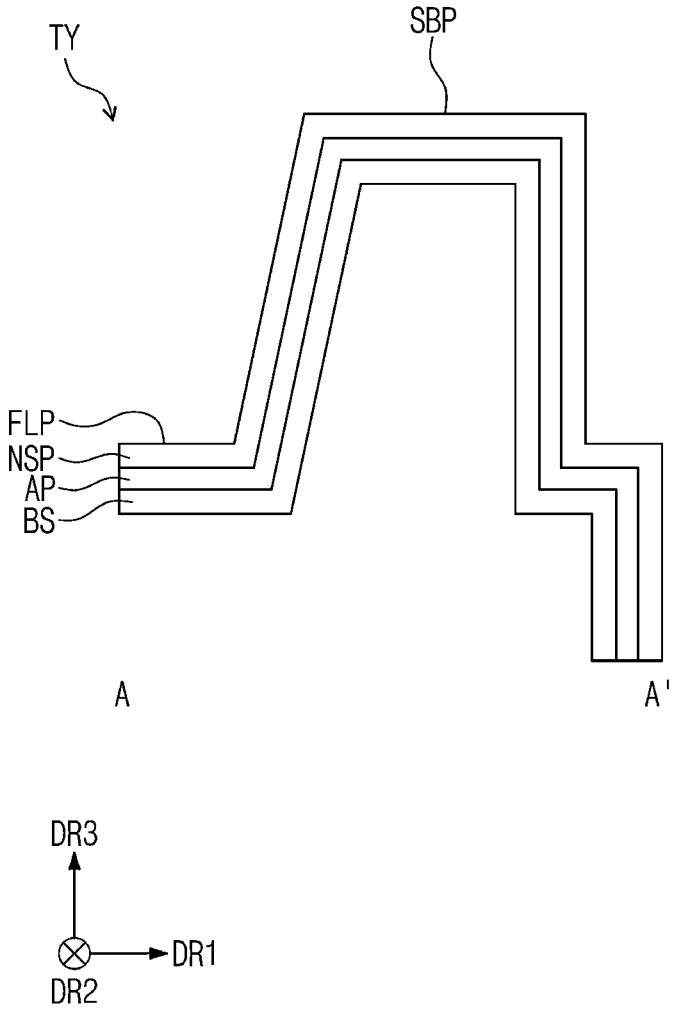
FIG. 2 is a cross-sectional view taken along line A-A' of FIG. 1.

FIG. 2 is a cross-sectional view taken along line A-A' of FIG. 1.

Referring to FIG. 2, each of the bottom portion FLP and the sidewall portion SBP of the tray TY may include a base tray BS, an adhesive layer AP, and a non-slip pad NSP, which are sequentially stacked in the third direction DR3.

The base tray BS may be a structure that is disposed at a lowermost surface of the tray TY and determines the shape of the tray TY. The base tray BS may include at least one of acrylonitrile-butadiene styrene ("ABS"), polyethylene terephthalate ("PET"), polycarbonate ("PC"), polypropylene ("PP"), and polyolefin resin, however, it should not be limited thereto or thereby. The base tray BS may include at least one of high-density polyethylene ("HDPE") and thermoplastic polyolefin ("TPO") in addition to the at least one of the above-described materials.

The adhesive layer AP may be disposed between the base tray BS and the non-slip pad NSP to attach the base tray BS to the non-slip pad NSP. In an embodiment, the non-slip pad NSP may be coupled to the base tray BS and may be separated from the base tray BS. That is, the non-slip pad NSP may be attached to the base tray BS by the adhesive layer AP and may be detached from the base tray BS. In an embodiment, the tray TY may be manufactured by an extrusion method, and thus, the non-slip pad NSP and the base tray BS may be unitary with each other. In detail, the non-slip pad NSP may be manufactured through a vacuum forming method after being formed with the base tray BS by the extrusion method as a sheet.

A lower surface of the non-slip pad NSP may be coupled to an upper surface of the base tray BS. In detail, the non-slip pad NSP may be coupled to the base tray BS in an entire area that overlaps the bottom portion FLP and the sidewall portion SBP. When the display panels DP (refer to FIG. 1) are loaded on the tray TY and transferred, the non-slip pad NSP may provide the display panels DP with a friction force, and thus may prevent the display panels DP from being damaged due to movement.

Figure 3:
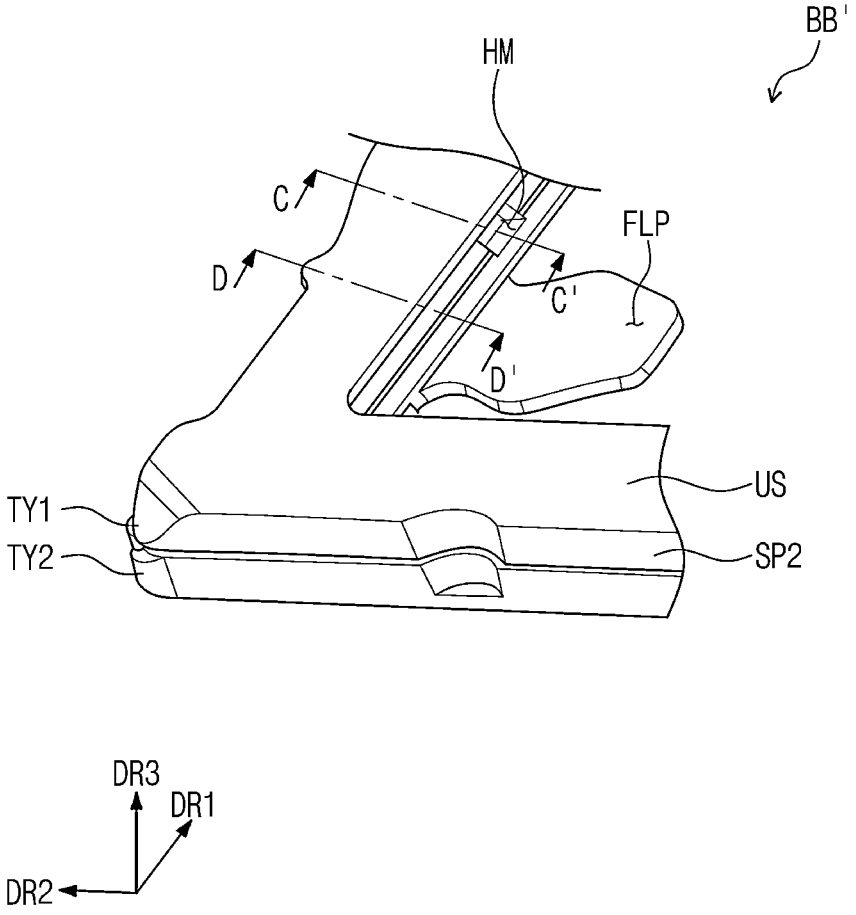
FIG. 3 is a perspective view of a portion corresponding to an area BB' of FIG. 1.

FIG. 3 is a perspective view of a portion BB' of FIG. 1.

Referring to FIG. 3, a plurality of first and second trays TY1 and TY2 may be stacked. FIG. 3 shows a structure in which a first tray TY1 and a second tray TY2 are stacked as an illustrative embodiment. The display panels DP (refer to FIG. 1) may be disposed on each of the first tray TY1 and the second tray TY2, and the display panels DP may be transferred while the first tray TY1 and the second tray TY2 are stacked one another.

The second tray TY2 may contact the first tray TY1. As described above, the non-slip pad NSP (refer to FIG. 2) may be provided to cover an entirety of the surface (e.g., an upper surface) of the base tray BS (refer to FIG. 2). Accordingly, the first tray TY1 and the second tray TY2 may be stuck together due to a large friction force of the non-slip pad NSP. When the first tray TY1 and the second tray TY2 are stuck together, the display panels DP may move during a process of separating the first and second trays TY1 and TY2 that are stuck together since a separate accommodation space to which the display panels DP (refer to FIG. 1) are fixed is not provided in the bottom portion FLP of the first or second tray TY1 or TY2. As a result, the display panel DP may be cracked or cut, and defects may occur in an apparatus used to transfer the first and second trays TY1 and TY2.

In the illustrated embodiment, the first or second tray TY1 or TY2 may have a shape to prevent the first and second trays TY1 and TY2 from being stuck together. In an embodiment, each of the first tray TY1 and the second tray TY2 may be provided with the groove defined therein. In this case, the second tray TY2 may not contact the first tray TY1 in the remaining area except the area where the groove is defined. That is, since the first tray TY1 contacts the second tray TY2 only in the area where the groove is defined, a contact area between the first tray TY1 and the second tray TY2 may be reduced, and the first and second trays TY1 and TY2 may be prevented from being stuck together. Accordingly, although the separate accommodation space desired to fix the display panel DP to the bottom portion FLP of the first or second tray TY1 or TY2 is not provided, the movement of the display panel DP may be prevented. In the illustrated embodiment, the groove may have a quadrangular shape, however, it should not be limited thereto or thereby. In an embodiment, the groove may have a polygonal, circular, oval, or irregular shape. The shape of the first or second tray TY1 or TY2 will be described in detail below.

Figure 4A:
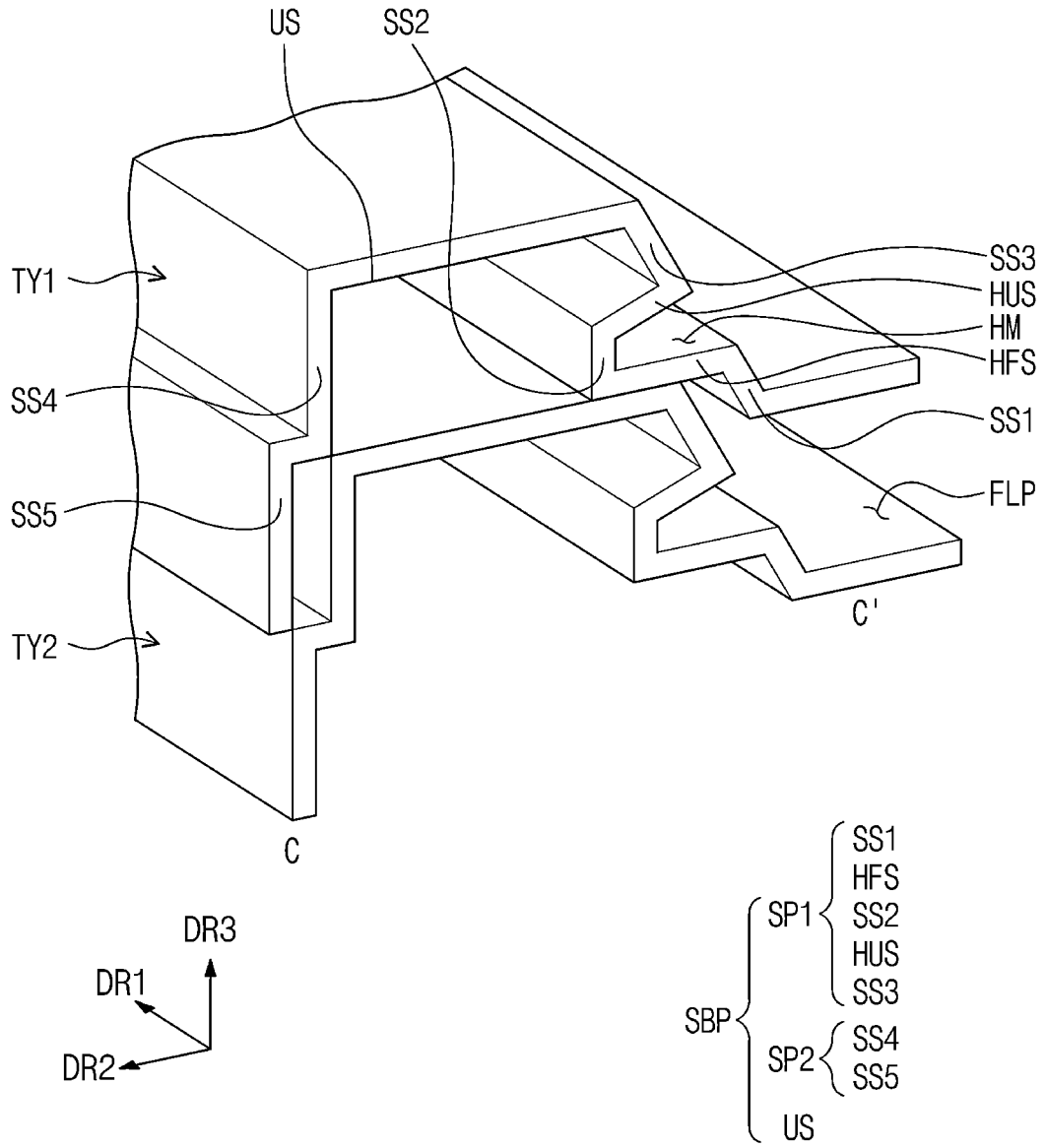
FIG. 4A is a perspective view taken along line C-C' of FIG. 3.
Figure 4B:
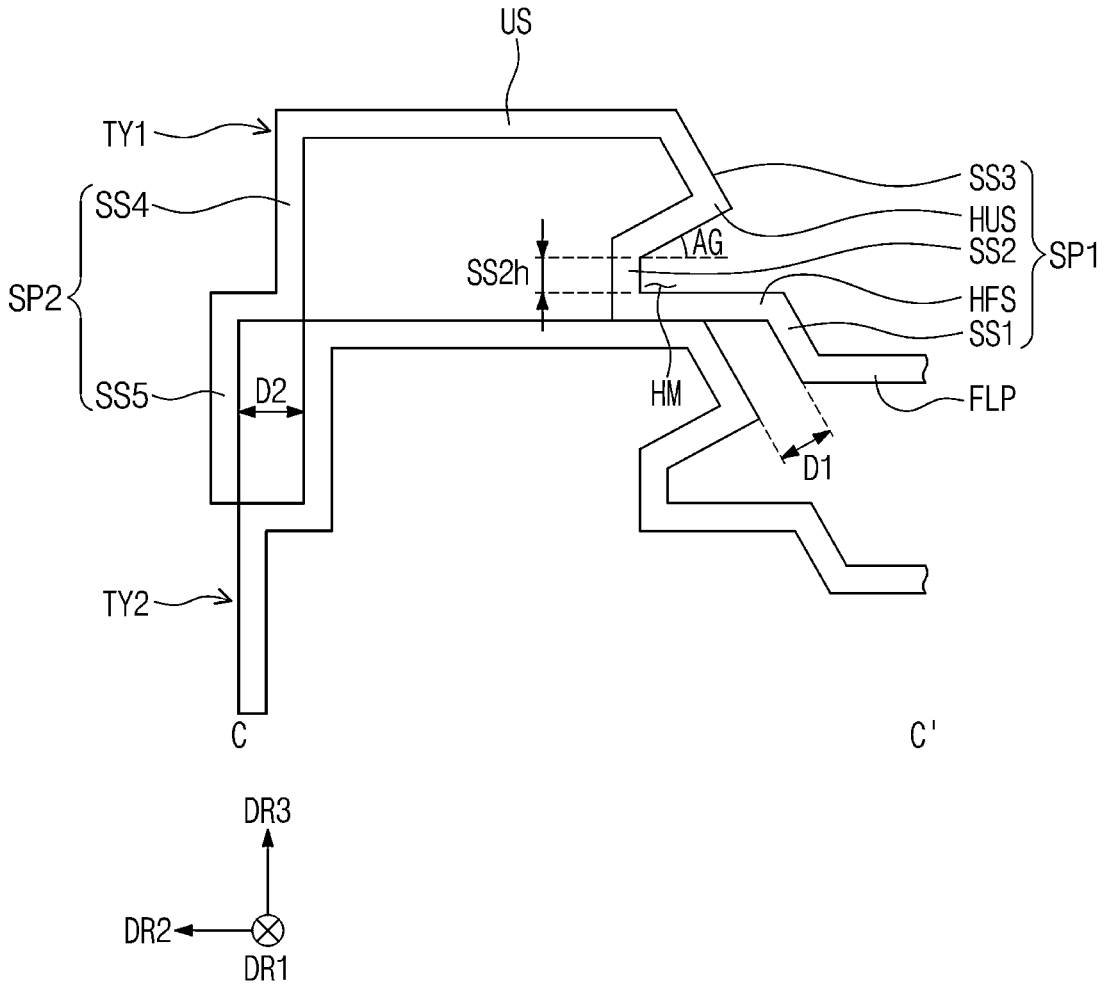
FIG. 4B is a cross-sectional view taken along line C-C' of FIG. 3.

FIG. 4A is a perspective view taken along line C-C' of FIG. 3, and FIG. 4B is a cross-sectional view taken along line C-C' of FIG. 3. FIGS. 4A and 4B show a portion taken along line C-C' when the first and second trays TY1 and TY2 are stacked one another.

Referring to FIGS. 4A and 4B, each of the first and second trays TY1 and TY2 may include the bottom portion FLP and the sidewall portion SBP. The sidewall portion SBP may include a first side portion SP1, an upper surface US, and a second side portion SP2.

The first side portion SP1 may include a first side surface SS1, a groove bottom surface HFS, a second side surface SS2, a groove upper surface HUS, and a third side surface SS3. The groove may be defined in the first side portion SP1, and the first side portion SP1 may extend from the bottom portion FLP. In an embodiment, the first side portion SP1 may be inclined with respect to the bottom portion FLP and may extend from the bottom portion FLP to a direction that is adjacent to the third direction DR3.

The first side surface SS1 may extend in a direction between the second direction DR2 and the third direction DR3 from the bottom portion FLP. The groove bottom surface HFS may extend from the first side surface SS1 to a direction away from the bottom portion FLP and may define the groove. The second side surface SS2 may extend from the groove bottom surface HFS to the third direction DR3 and may define the groove. The groove upper surface HUS may extend from the second side surface SS2 to a direction toward the bottom portion FLP and may define the groove. The third side surface SS3 may extend from the groove upper surface HUS and may be connected to the upper surface US. The groove upper surface HUS may be inclined with respect to the groove bottom surface HFS at a predetermined angle AG.

The first side surface SS1 of each of the first and second trays TY1 and TY2 may protrude more than the third side surface SS3 of each of the first and second trays TY1 and TY2. Accordingly, in the structure in which the first tray TY1 and the second tray TY2 are stacked one another, an extension line of the first side surface SS1 of the first tray TY1 and an extension line of the third side surface SS3 of the second tray TY2 may be spaced apart from each other by a first distance D1. The first distance D1 may be equal to or greater than about 1.0 millimeter (mm) and equal to or smaller than about 1.5 mm. When the first distance D1 is smaller than about 1.0 mm, the trays may be stuck together due to a variation in thickness of a material in the process of manufacturing the first or second tray TY1 or TY2. That is, when manufacturing the first or second tray TY1 or TY2, it is desired to secure a margin area, which is defined between the sidewall portions SBP of the trays TY1 and TY2, of about 1.0 mm or more in consideration of the thickness of the material. When the first distance D1 is greater than about 1.5 mm, a gap between the first and second trays TY1 and TY2 stacked one another may increase, and thus, the first or second tray TY1 or TY2 may move left and right.

In a plan view, the upper surface US may extend from the first side portion SP1 to a direction away from the bottom portion FLP. That is, the upper surface US may extend from the first side portion SP1 to the second direction DR2.

The second side portion SP2 may extend from the upper surface US and may face the first side portion SP1. The second side portion SP2 may include a fourth side surface SS4 and a fifth side surface SS5. The fourth side surface SS4 may extend from the upper surface US to a direction opposite to the third direction DR3. In the plan view, the fifth side surface SS5 may extend from the fourth side surface SS4 to a direction away from the bottom portion FLP. That is, the fifth side surface SS5 may extend from the fourth side surface SS4 to the second direction DR2 in in the plan view.

An extension line of the fourth side surface SS4 and an extension line of the fifth side surface SS5 may be spaced apart from each other by a second distance D2. The second distance D2 may be equal to or greater than about 1.0 mm and equal to or smaller than about 1.5 mm. When the second distance D2 is smaller than about 1.0 mm, the trays may be stuck together due to the variation in thickness of the material in the process of manufacturing the first or second tray TY1 or TY2. That is, when manufacturing the first or second tray TY1 or TY2, it is desired to secure a margin area, which is defined between the sidewall portions SBP of the trays TY1 and TY2, of about 1.0 mm or more in consideration of the thickness of the material. When the second distance D2 is greater than about 1.5 mm, a gap between the first and second trays TY1 and TY2 stacked one another may increase, and thus, the first or second tray TY1 or TY2 may move left and right.

Figure 5A:
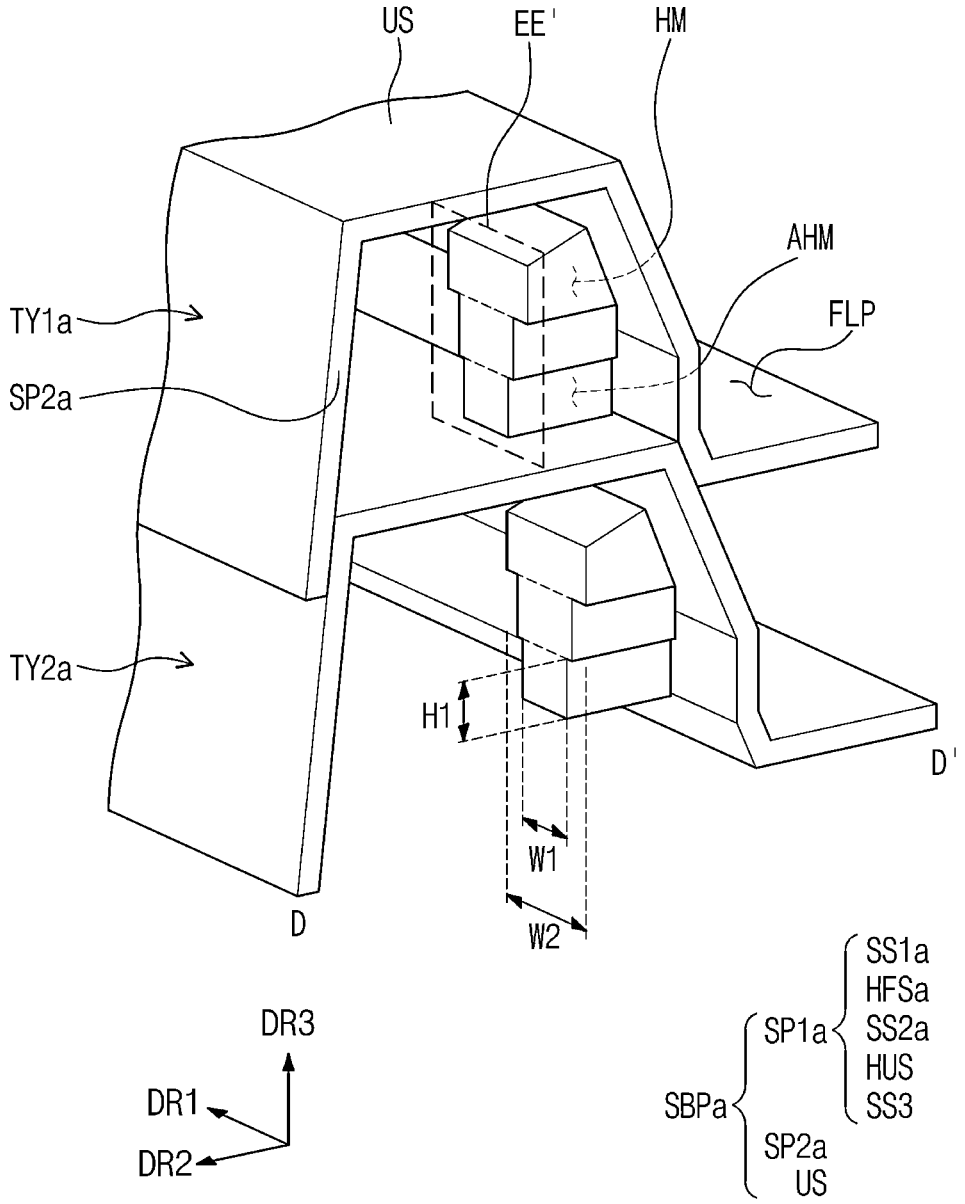
FIG. 5A is a perspective view taken along line D-D' of FIG. 3.
Figure 5B:
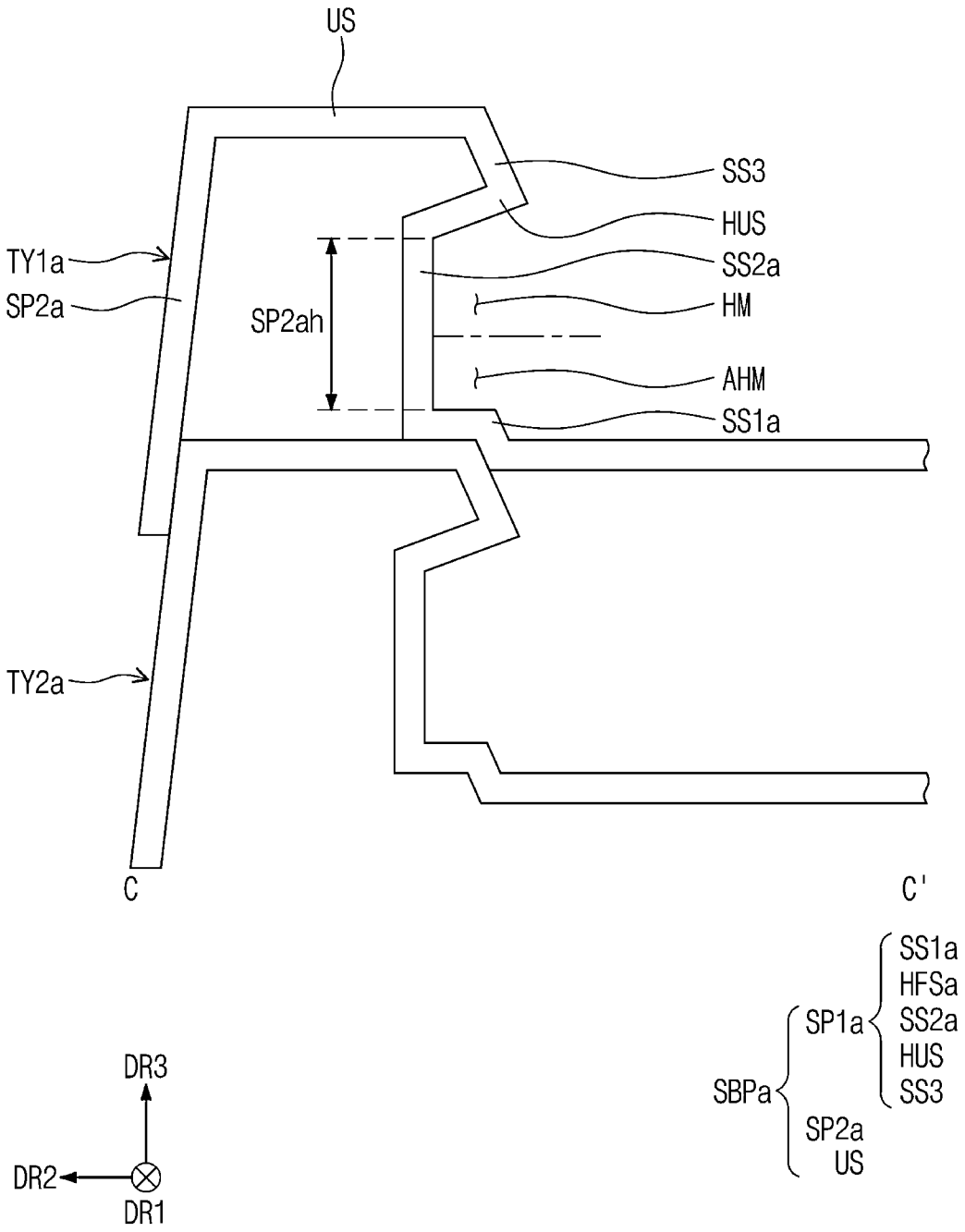
FIG. 5B is a cross-sectional view taken along line C-C' of FIG. 3.
Figure 5C:
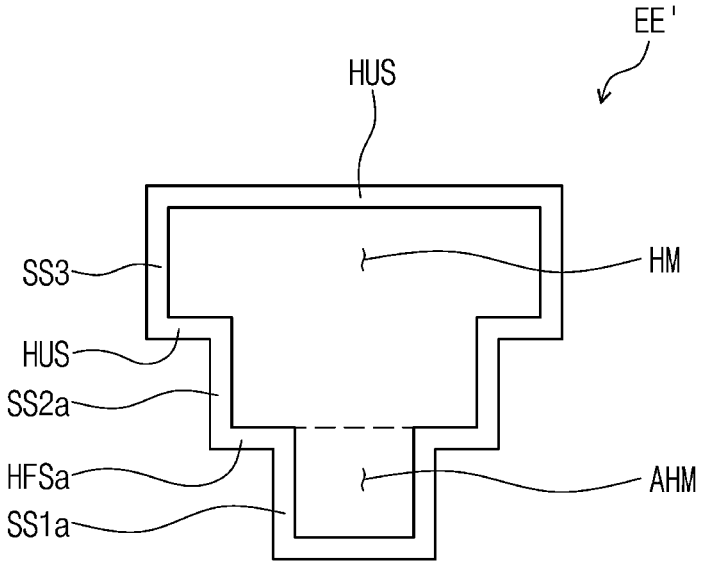
FIG. 5C is an enlarged cross-sectional view of a portion EE' of FIG. 5A.

FIG. 5A is a perspective view taken along line D-D' of FIG. 3. FIG. 5B is a cross-sectional view taken along line C-C' of FIG. 3. FIG. 5C is an enlarged cross-sectional view of a portion EE' of FIG. 5A. FIGS. 5A and 5B show a portion taken along line C-C' or D-D' when first and second trays TY1*a* and TY2*a* are stacked one another. In FIGS. 5A to 5C, the same reference numerals denote the same elements in FIGS. 4A and 4B, and thus, detailed descriptions of the same elements will be omitted.

Referring to FIGS. 5A to 5C, each of the first and second trays TY1*a* and TY2*a* may include a bottom portion FLP and a sidewall portion SBPa. The sidewall portion SBPa may include a first side portion SP1*a*, an upper surface US, and a second side portion SP2*a*.

The first side portion SP1*a* may include a first side surface SS1*a*, a groove bottom surface HFSa, a second side surface SS2*a*, a groove upper surface HUS, and a third side surface SS3. The first side portion SP1*a* may be provided with a groove HM, and an additional groove AHM recessed from the groove bottom surface HFSa may be further defined. In detail, the additional groove AHM may be a space recessed in a direction opposite to the third direction DR3 from the groove bottom surface HFSa. The additional groove AHM may be defined under the groove. Accordingly, a length SS2*ah* in the third direction DR3 of the second side surface SS2*a* may be longer than a length SS2*h* (refer to FIG. 4B) in the third direction DR3 of the second side surface SS2 (refer to FIG. 4B) through which the additional groove AHM is not defined. The additional groove AHM may support the first or second tray TY1*a* or TY2*a* and may support a load of the first or second tray TY1*a* or TY2*a*.

A width W2 of the groove HM may be equal to or greater than about 10 mm. When the width W2 of the groove HM is smaller than about 10 mm and the first or second tray TY1*a* or TY2*a* is manufactured by the vacuum forming method, the shape of the first or second tray TY1*a* or TY2*a* may not be implemented. That is, a minimum margin of the width W2 of the groove HM, which is desired to manufacture the first or second tray TY1*a* or TY2*a*, may be about 10 mm.

A width W1 of the additional groove AHM may be smaller than the width W2 of the groove. As a result, a contact area between a first tray TY1*a* and a second tray TY2*a* may be reduced. Accordingly, the sticking of the trays caused by the friction force of the non-slip pad NSP (refer to FIG. 2) may be reduced or prevented. The width W1 of the additional groove AHM may be equal to or smaller than about 5 mm. When the width W1 of the additional groove AHM is greater than about 5 mm, the sticking of the trays due to the friction force of the non-slip pad NSP may increase.

A height H1 of the additional groove AHM may be equal to or greater than about 3 mm. When the height H1 of the additional groove AHM is smaller than about 3 mm and the first or second tray TY1*a* or TY2*a* is manufactured by the vacuum forming method, the shape of the first or second tray TY1*a* or TY2*a* may not be implemented. That is, a minimum margin of the height of the additional groove AHM, which is desired to manufacture the first or second tray TY1*a* or TY2*a*, may be about 3 mm.

The second side portion SP2*a* may extend from the upper surface US and may face the first side portion SP1*a*. The second side portion SP2*a* may extend from the upper surface US to the direction opposite to the third direction DR3 and may have a straight-line shape.

Figure 6:
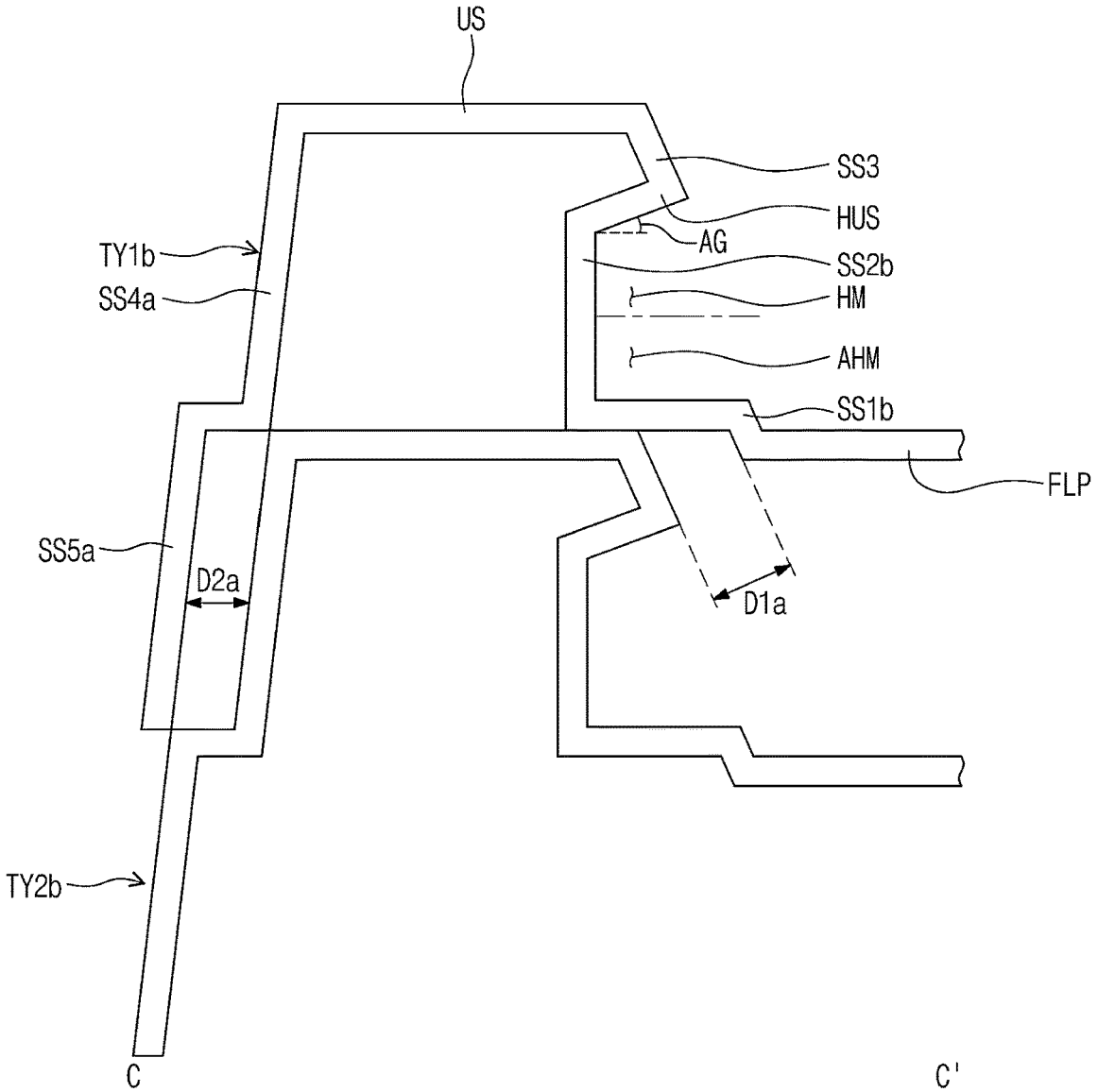
FIG. 6 is a cross-sectional view taken along line C-C' of FIG. 3.
Figure 6:
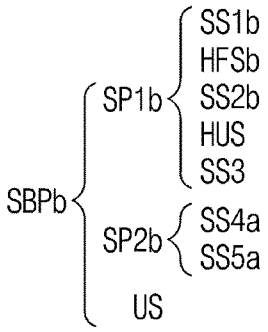
Figure 6:
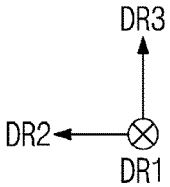

FIG. 6 is a cross-sectional view taken along line C-C' of FIG. 3. FIG. 6 shows a portion taken along line C-C' when first or second trays TY1*b* or TY2*b* are stacked one another. In FIG. 6, the same reference numerals denote the same elements in FIGS. 4A to 5C, and thus, detailed descriptions of the same elements will be omitted.

Referring to FIG. 6, the first or second tray TY1*b* or TY2*b* may have a shape obtained by combining the first or second tray TY1 or TY2 of FIG. 4A with the first or second tray TY1*a* or TY2*a* of FIG. 5A. Each of the first and second trays TY1*b* and TY2*b* may include a bottom portion FLP and a sidewall portion SBPb. The sidewall portion SBPb may include a first side portion SP1*b*, an upper surface US, and a second side portion SP2*b*.

The first side portion SP1*b* may include a first side surface SS1*b*, a groove bottom surface HFSb, a second side surface SS2*b*, a groove upper surface HUS, and a third side surface SS3. The first side portion SP1*b* may be provided with a groove HM defined therein, and the first side portion SP1*b* may extend from the bottom portion FLP to the third direction DR3. An additional groove AHM protruding from the groove bottom surface HFSb may be further defined in the first side portion SP1*b*, the additional groove AHM may be a space recessed in a direction opposite to the third direction DR3 from the groove bottom surface HFSb. The additional groove AHM may be defined under the groove. The additional groove AHM may support the first or second tray TY1*b* or TY2*b* and may support a load of the first or second tray TY1*b* or TY2*b*.

The first side surface SS1*b* may extend in a direction between the second direction DR2 and the third direction DR3 from the bottom portion FLP. The groove bottom surface HFSb may extend from the first side surface SS1*b* to the second direction DR2 and may define the groove. The second side surface SS2*b* may extend from the groove bottom surface HFSb to the third direction DR3 and may define the groove. The groove upper surface HUS may extend from the second side surface SS2*b* and may define the groove. The third side surface SS3 may extend from the groove upper surface HUS and may be connected to the upper surface US. The groove upper surface HUS may be inclined with respect to the groove bottom surface HFS at a predetermined angle AG.

An extension line of the first side surface SS1*b* of the first tray TY1*b* and an extension line of the third side surface SS3 of the second tray TY2*b* may be spaced apart from each other by a first distance D1*a*. The first distance D1*a* may be equal to or greater than about 1.0 mm and equal to or smaller than about 1.5 mm. When the first distance D1*a* is smaller than about 1.0 mm, the trays may be stuck together due to a variation in thickness of a material in the process of manufacturing the first or second tray TY1*b* or TY2*b*. That is, when manufacturing the first or second tray TY1*b* or TY2*b*, it is desired to secure a margin area of about 1.0 mm or more in consideration of the thickness of the material. When the first distance D1*a* is greater than about 1.5 mm, a gap between the first and second trays TY1*b* and TY2*b* stacked one another may increase, and thus, the first or second tray TY1*b* or TY2*b* may move left and right.

In a plan view, the upper surface US may extend from the first side portion SP1*b* to a direction away from the bottom portion FLP. That is, the upper surface US may extend from the first side portion SP1*b* to the second direction DR2.

The second side portion SP2*b* may extend from the upper surface US and may face the first side portion SP1*b*. The second side portion SP2*b* may include a fourth side surface SS4*a* and a fifth side surface SS5*a*. The fourth side surface SS4*a* may extend from the upper surface US to the direction opposite to the third direction DR3. In the plan view, the fifth side surface SS5*a* may extend from the fourth side surface SS4*a* to a direction away from the bottom portion FLP. That is, the fifth side surface SS5*a* may extend from the fourth side surface SS4*a* to the second direction DR2 in the plan view.

An extension line of the fourth side surface SS4*a* and an extension line of the fifth side surface SS5*a* may be spaced apart from each other by a second distance D2*a*. The second distance D2*a* may be equal to or greater than about 1.0 mm and equal to or smaller than about 1.5 mm. When the second distance D2*a* is smaller than about 1.0 mm, the trays may be stuck together due to the variation in thickness of the material in the process of manufacturing the first or second tray TY1*b* or TY2*b*. That is, when manufacturing the first or second tray TY1*b* or TY2*b*, it is desired to secure a margin area, which is defined between the sidewall portions SBPb of the trays TY1*b* and TY2*b*, of about 1.0 mm or more in consideration of the thickness of the material. When the second distance D2*a* is greater than about 1.5 mm, a gap between the first and second trays TY1*b* and TY2*b* stacked one another may increase, and thus, the first or second tray TY1 or TY2 may move left and right.

According to the disclosure, the sticking of the first and second trays TY1*b* and TY2*b* may be prevented from occurring due to a margin space between the sidewall portions SBPb of the first and second trays TY1*b* and TY2*b* and the additional groove AHM, and the movement of the display panels DP (refer to FIG. 1) may be prevented when the display panels DP (refer to FIG. 1) are transferred.

Since each of the trays may include the non-slip pad, the display panels DP may be loaded in the first or second tray TY1*b* or TY2*b* without including separate parts, and thus, the display panels DP (refer to FIG. 1) may be prevented from moving while being transferred. The first and second trays TY1*b* and TY2*b* may be prevented from being stuck together due to the margin space between the sidewall portions SBPb of the first and second trays TY1*b* and TY2*b* and the additional groove AHM.

In addition, the first or second tray TY1*b* or TY2*b* may be used not only for the display panel DP, but also for the transportation of other products. Accordingly, as an additional mold to manufacture the first or second tray TY1*b* or TY2*b* is not desired, a manufacturing cost may be reduced, and a product efficiency may be improved. In addition, since the first or second tray TY1*b* or TY2*b* is used in common, a purchase quantity of the first or second tray TY1*b* or TY2*b* may be reduced. In addition, as a work of replacing the first or second tray TY1*b* or TY2*b* for each product is omitted, a productivity may be improved.

Although the embodiments of the disclosure have been described, it is understood that the disclosure should not be limited to these embodiments but various changes and modifications may be made by one ordinary skilled in the art within the spirit and scope of the disclosure as hereinafter claimed. Therefore, the disclosed subject matter should not be limited to any single embodiment described herein, and the scope of the invention shall be determined according to the attached claims.

What is claimed is:

1. A tray comprising:

a bottom portion comprising a plurality of protrusion patterns; and a sidewall portion protruded from the bottom portion, the sidewall portion comprising:

a first side portion provided with a groove defined therein and extending from the bottom portion;

an upper surface extending from the first side portion to a direction away from the bottom portion in a plan view; and a second side portion extending from the upper surface and facing the first side portion.

2. The tray of claim 1, wherein the groove is spaced apart from the bottom portion.

3. The tray of claim 1, wherein the first side portion comprises:

a first side surface extending from the bottom portion;

a groove bottom surface extending from the first side surface and defining the groove;

a second side surface extending from the groove bottom surface and defining the groove;

a groove upper surface extending from the second side surface and defining the groove; and a third side surface extending from the groove upper surface and connected to the upper surface.

4. The tray of claim 3, wherein the first side surface is protruded more than the third side surface in the plan view.

5. The tray of claim 3, wherein the groove upper surface is inclined with respect to the groove bottom surface.

6. The tray of claim 3, wherein the first side portion is further provided with an additional groove recessed from the groove bottom surface.

7. The tray of claim 6, wherein the additional groove has a width smaller than a width of the groove.

8. The tray of claim 6, wherein a width of the additional groove is equal to or smaller than about 5 millimeters.

9. The tray of claim 6, wherein the additional groove has a height equal to or greater than about 3 millimeters.

10. The tray of claim 1, wherein the groove has a width equal to or greater than about 10 millimeters.

11. The tray of claim 1, wherein the second side portion comprises:

a fourth side surface extending from the upper surface; and a fifth side surface extending from the fourth side surface to the direction away from the bottom portion in the plan view.

12. The tray of claim 11, wherein an extension line of the fourth side surface and an extension line of the fifth side surface are spaced apart from each other with a distance equal to or greater than about 1.0 millimeter and equal to or smaller than about 1.5 millimeters.

13. The tray of claim 1, wherein the bottom portion further comprises a movement preventing member disposed at a center of the bottom portion and having a cylindrical shape.

14. The tray of claim 1, wherein each of the plurality of protrusion patterns has a hexagonal shape.

15. The tray of claim 1, wherein each of the bottom portion and the sidewall portion comprises a base tray, an adhesive layer, and a non-slip pad, which are sequentially stacked.

* * * * *